US008373080B2

(12) United States Patent
Schateikis et al.

(10) Patent No.: US 8,373,080 B2
(45) Date of Patent: Feb. 12, 2013

(54) METHOD AND DEVICE FOR DISCARDING INCOMPLETE SETS OF CAPS

(75) Inventors: Dieter Schateikis, Stolberg (DE); Markus Bohn, Stuttgart (DE)

(73) Assignee: Gruenenthal GmbH, Aachen (DE)

( * ) Notice: Subject to any disclaimer, the term of this patent is extended or adjusted under 35 U.S.C. 154(b) by 928 days.

(21) Appl. No.: 11/910,869

(22) PCT Filed: Apr. 4, 2006

(86) PCT No.: PCT/EP2006/061311

§ 371 (c)(1),
(2), (4) Date: May 27, 2008

(87) PCT Pub. No.: WO2006/106105

PCT Pub. Date: Oct. 12, 2006

(65) Prior Publication Data

US 2008/0245708 A1 Oct. 9, 2008

(30) Foreign Application Priority Data

Apr. 7, 2005 (DE) ..... 10 2005 016 169

(51) Int. Cl.
*B07C 5/00* (2006.01)

(52) U.S. Cl. ..... 209/524; 209/523; 209/536

(58) Field of Classification Search ..... 209/517, 209/518, 522–524, 536, 552
See application file for complete search history.

(56) References Cited

U.S. PATENT DOCUMENTS

| | | | | |
|---|---|---|---|---|
| 3,110,400 | A * | 11/1963 | Early | 209/523 |
| 3,395,573 | A * | 8/1968 | Baker et al. | 73/104 |
| 3,717,248 | A * | 2/1973 | Scribner | 209/523 |
| 4,266,674 | A * | 5/1981 | Bell et al. | 209/536 |
| 4,870,806 | A * | 10/1989 | Sprenger | 53/485 |
| 5,097,653 | A * | 3/1992 | Soloman | 53/499 |
| 6,434,911 | B1 * | 8/2002 | Yamamoto et al. | 53/53 |
| 7,669,781 | B2 * | 3/2010 | Sternberger et al. | 239/33 |
| 2003/0041565 | A1 | 3/2003 | Banks et al. | |
| 2006/0043207 | A1 | 3/2006 | Sedaghat Kerdar et al. | |

FOREIGN PATENT DOCUMENTS

| | | | |
|---|---|---|---|
| DE | 100 03 625 | C1 | 9/2001 |
| DE | 103 08 175 | A1 | 9/2004 |
| EP | 0 544 089 | A2 | 6/1993 |
| JP | 3-293069 | A | 12/1991 |
| WO | WO 2006136384 | A1 * | 12/2006 |
| WO | WO 2010127416 | A2 * | 11/2010 |

OTHER PUBLICATIONS

Form PCT/IB/338 (one (1) page) and Form PCT//IPEA/409 (four (4) pages) for a total of (five (5) pages).
International Search Report dated Jul. 5, 2006 with English translation of relevant portion and Form PCT/ISA/237 (Eleven (11) Pages).
German Search Office Action dated Dec. 20, 2007 (Three (3) Pages).

* cited by examiner

*Primary Examiner* — Joseph C Rodriguez
(74) *Attorney, Agent, or Firm* — Crowell & Moring LLP

(57) ABSTRACT

A method and a device relating to handling caps for drinking straws is provided. In particular, the method and device provide for examining caps and discarding incomplete sets of caps and/or sets of caps in which at least one cap is aligned incorrectly.

2 Claims, 3 Drawing Sheets

METHOD AND DEVICE FOR DISCARDING INCOMPLETE SETS OF CAPS

The present invention relates to a method and a device for discarding incomplete sets of caps and/or sets of caps in which at least one cap is aligned incorrectly.

Drinking straws are at the present time often used for administering substances such as medicinal drugs, active ingredients, vitamins, food, and/or nutritional supplements. The substances exist in the form of granules, pellets, microtablets, and powders. The substance is located in the drinking straw and is sucked, preferably with a liquid, from the drinking straw into the patient's or consumer's mouth. In order to prevent the substances from escaping from the drinking straw before it is consumed, the latter is closed by a cap at least at one of its ends. Since drinking straws are usually produced in sets, i.e. in multiple numbers simultaneously, it is necessary to ensure, inter alia, that the set of caps provided for closing purposes is complete at all times, with the caps aligned such that they can be mounted on the drinking straws. Caps that are incorrectly aligned must therefore be discarded.

It is therefore an object of the present invention to provide a method for discarding caps adapted to be mounted on a set of drinking straws.

This object is achieved by a method for discarding caps adapted to be mounted on a set of drinking straws, in which method all caps of a set are discarded, if one cap is aligned incorrectly and/or the set of caps is incomplete.

To those skilled in the art, it was extremely astonishing and not to be expected that the method of the invention enabled drinking straws to be closed by caps securely, reliably, easily, and economically.

According to the invention, a set of drinking straws comprising a plurality of drinking straws that are aligned preferably parallel to each other and more preferably in the vertical direction are very preferably to be closed by caps substantially simultaneously. At this point in time, the drinking straws have already been filled with the substance to be administered or consumed. Since the machines on which the drinking straws are processed and filled operate clock pulsewise and since several, say, 10 drinking straws are processed and transported simultaneously in one clock pulse, it is preferable for a set of caps to be mounted on a set of drinking straws also simultaneously, that is to say, for each set of drinking straws to be provided substantially simultaneously with caps, it is necessary to provide, in a cap mounting station, an equal number of caps, which have to be aligned such that that side of the cap which is to be mounted on the straw is arranged so as to face the drinking straw. If the number of drinking straws produced simultaneously in one clock pulse of the machine is such that not all the drinking straws are provided with a cap simultaneously, then each set must at all events comprise as many caps as are mounted substantially simultaneously on a drinking straw.

Since the caps are not inserted manually into the cap mounting station, it is necessary to ensure that each set of caps is complete before the latter are mounted on the drinking straws, and that all the caps of a set are correctly aligned. According to the invention, a set of caps is therefore checked for completeness and correct alignment of the caps, preferably as soon as the straws in a set are separated from each other. Furthermore, according to the invention, an incomplete set or a set containing at least one incorrectly aligned and/or damaged cap is discarded as a whole instead of discarding only the incorrectly aligned cap.

The caps are preferably discarded by changing their position. For example, a set of caps that fails to meet the desired requirements could be rotated toward a reject bin. The caps in this reject bin are either disposed of or reused in the production process.

A set of caps which is complete and in which all caps are aligned correctly is then pressed on the drinking straws preferably in such a way that the caps will not detach themselves from the drinking straws, but on the other hand the force required to remove the caps will not be so great that it cannot be applied by, in particular, older patients.

The complete sets of caps in which all caps are aligned correctly are preferably stored temporarily prior to the mounting process. The advantage of this embodiment of the method of the invention is that the inspection or discarding of the caps need not be synchronized with that clock pulse of the machine in which the drinking straws are processed and filled. Another advantage of this preferred embodiment of the method of the invention is that the production of drinking straws need not be interrupted even when several sets of caps come up one behind the other that are either incomplete or contain at least one incorrectly aligned cap.

Another object of the present invention is a device for discarding incomplete sets of caps adapted to be mounted on drinking straws, which device comprises a rotary drum that has a number of openings equal to that of a set of caps.

These openings are dimensioned such that each can receive one cap. The completeness of a set of caps and the alignment of each cap are then examined in the openings. Preferably therefore, at least two bores are disposed in the region of each opening, and the signals of a sensor, for example, beams of light, can be transmitted through the bores. It is possible to use these signals firstly to examine whether a cap is present in the respective opening and/or, secondly, to check whether this cap is correctly aligned.

The drum is then rotated to a mounting position or to an ejection position depending on the result of this examination. In the case of an incomplete set of caps or at least one incorrectly aligned cap, the rotary drum is rotated into the ejection position. In this position, all caps located in the rotary drum are discarded to, say, a reject bin. If the result of the examination reveals a complete set of caps, all of which are aligned correctly, the drum is rotated to a mounting position and the caps are mounted on the drinking straws using mounting means and/or the caps are temporarily stored before they are mounted on the drinking straws.

The invention will be explained below with reference to FIGS. 1 to 3. This explanation only serves as an example and does not restrict the general scope of the invention. The following explanation applies to the device of the invention and to the method of the invention alike.

Figure 1:
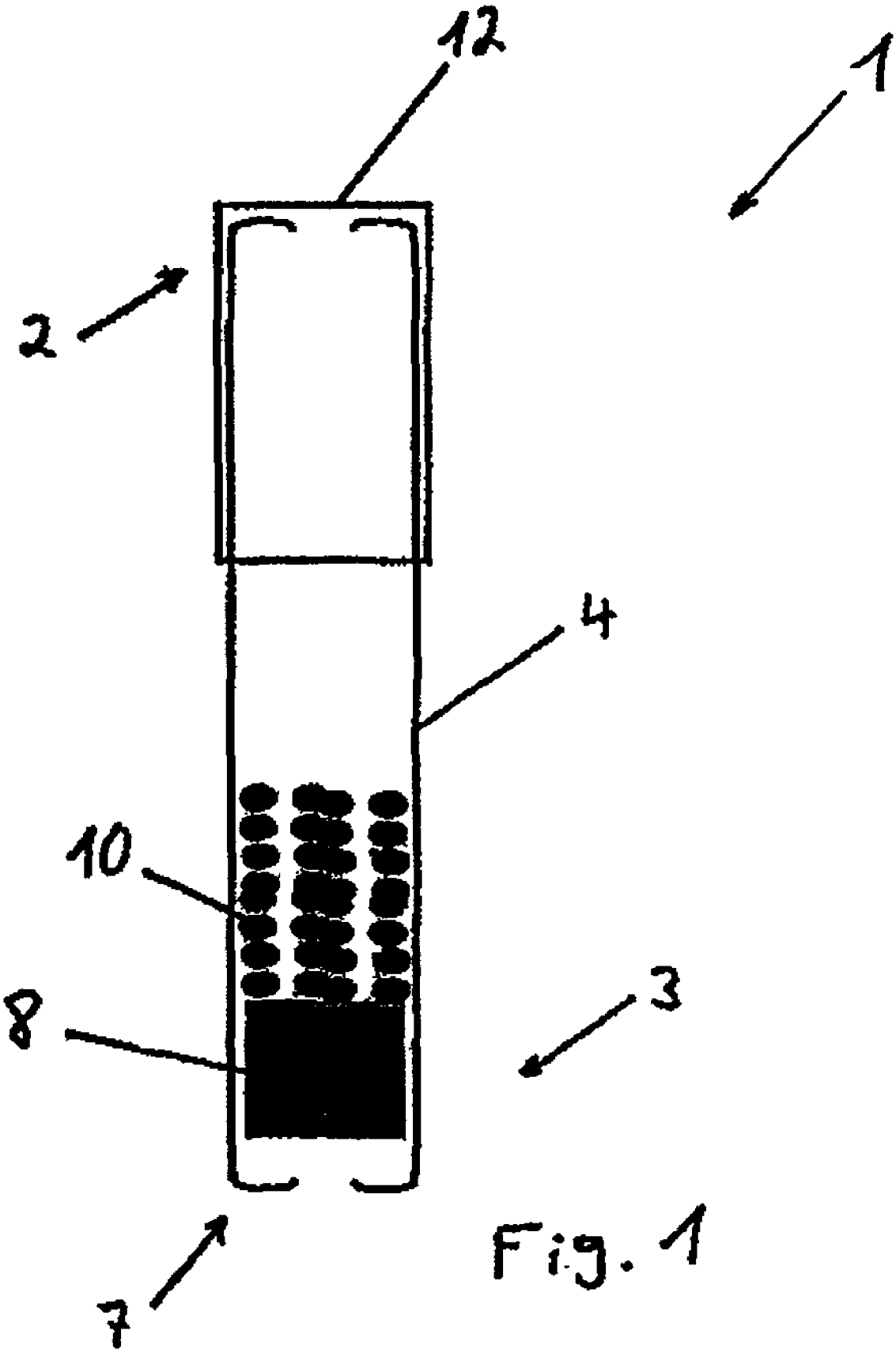
FIG. 1 shows a drinking straw with a cap.

FIG. 1 shows a drinking straw 4, which is closed by a cap 12 at its upper end 2. In the interior of the drinking straw there is located a controller 8, which on the one hand prevents the substance 10 located above the controller 8 from trickling out of the drinking straw from the lower end thereof. On the other hand, the controller can check whether the substance has been completely sucked from the drinking straw. The cap 12 disposed at the top 2 prevents the substance 10 from escaping from the drinking straw before it is consumed.

Figure 2:
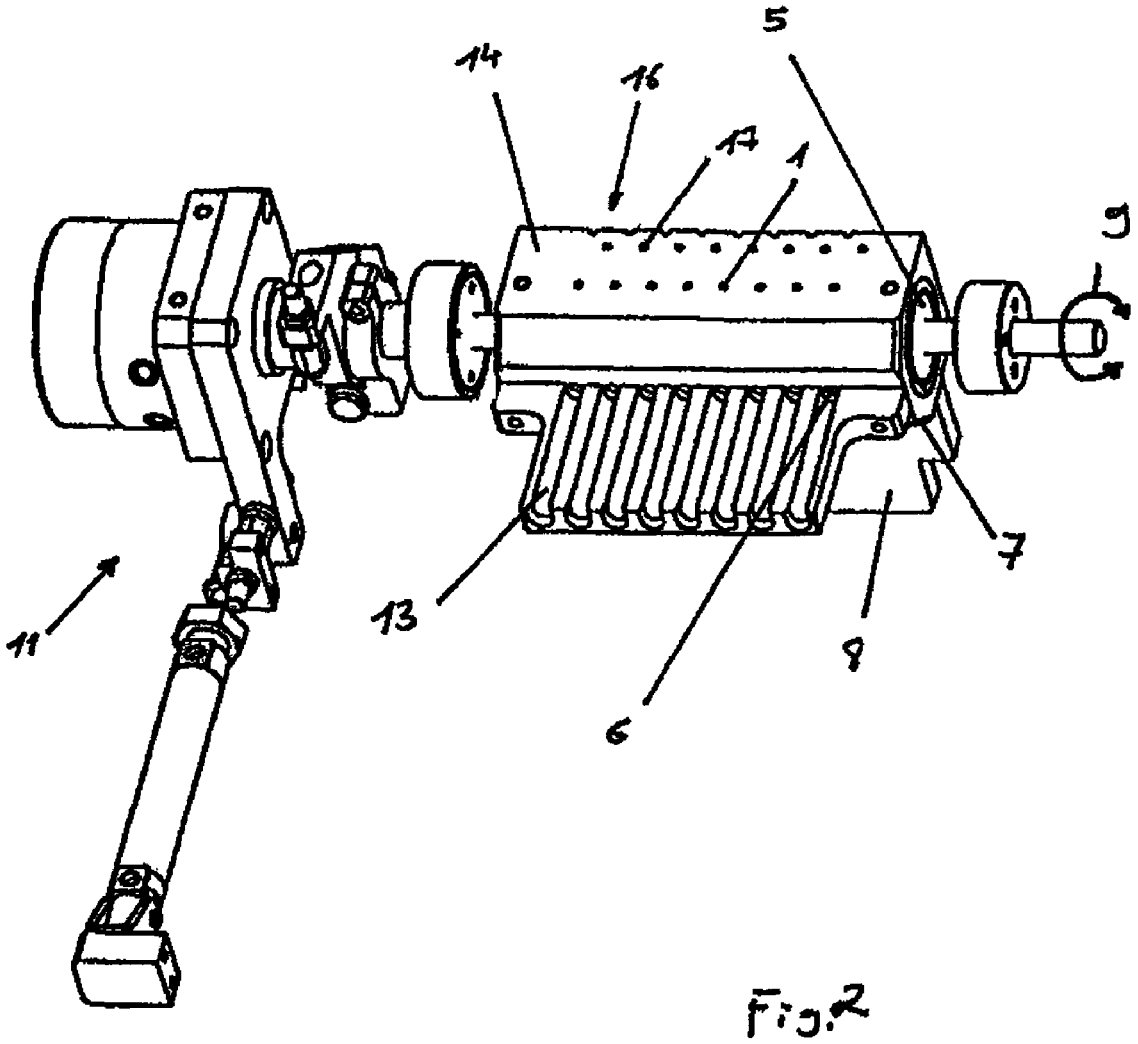
FIG. 2 is a view of a rotary drum.

FIG. 2 shows a device by means of which incomplete sets of caps or sets of caps in which at least one cap is incorrectly aligned can be discarded. The caps (not shown), located one behind the other, are transported through supply channels 13 toward the drum 5, for example by a vibrating conveyor. The drum 5 comprises openings 6, the number of which (in this case eight) is equal to the number of supply channels 13. The number of openings is also equal to that of a set of caps 12, each to be mounted simultaneously on a drinking straw. The openings 6 of the drum 5 are dimensioned such that they can each receive one cap 12 in such a way that the drum can rotate without damaging the caps. Once the caps have been transported into the eight openings 6, two sensors—in this case light sensors (not shown)—are used to examine whether a cap is located in each opening and whether the cap is correctly aligned. For this purpose, the block 14 in which the drum 5 is mounted comprises at least one bore for each opening 6. This bore is located in the present case on the rear side 16 of the block 14. A beam of light can be guided through the bores into the opening 6. This beam of light can be implemented to examine whether a cap is present in the respective opening and also whether the cap is correctly aligned. The bores 17 can further serve to determine whether the position of the caps within the drum is correct. Following the examination, the drum 5 is rotated by the drive 11, as shown by the double-headed arrow 9. If the set of caps is incomplete or at least one cap is incorrectly aligned, the drum is rotated counter-clockwise through 45° such that the openings 6 are in register with a corresponding number of openings present at the ejection position 7. In this position, all caps currently located in the rotary drum are ejected, i.e. discarded, through the ejection openings 7 out of the drum into, say, a reject bin (not shown), using compressed air or the like. If the examination reveals that a cap is located in each opening and that the caps are aligned correctly, the drum is rotated counter-clockwise through 90° so that the openings 6 are in register with the openings at the mounting position 8. In this position, the caps are then temporarily stored and later placed on the corresponding set of drinking straws. As soon as the caps are discarded or deposited for temporary storage, the drum is again rotated to the horizontal position, and a new set of caps can be inserted into the openings 6.

Figure 3:
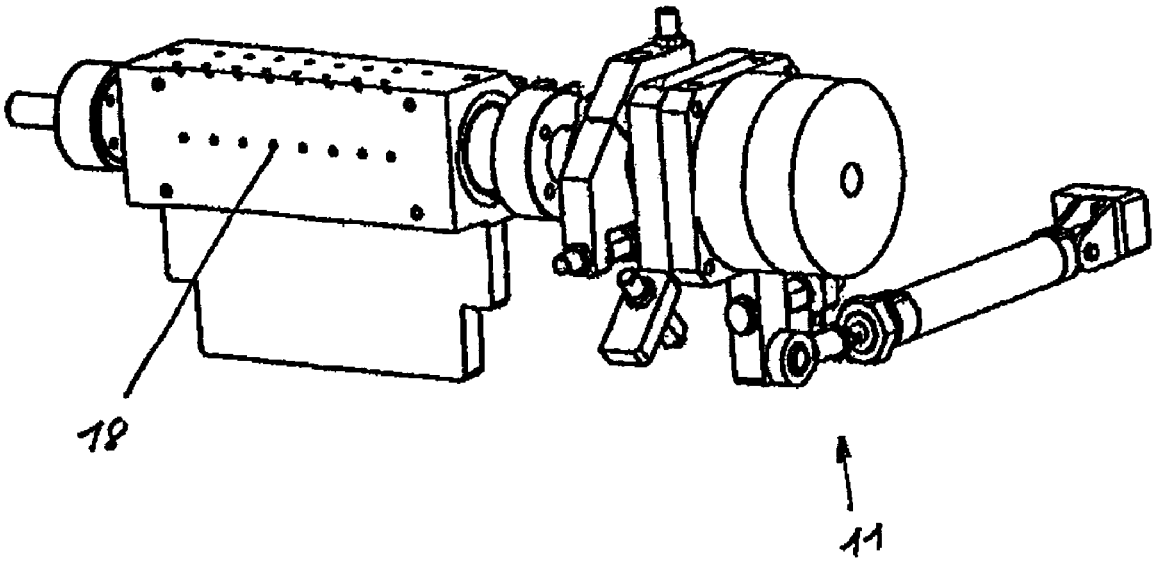
FIG. 3 is another view of the rotary drum shown in FIG. 2.

FIG. 3 is another view of the drum shown in FIG. 2, in which the bores 18 can be seen, by means of which the caps are checked for completeness and correct alignment.

LIST OF REFERENCE NUMERALS

1 drinking straw
2 top end
3 bottom end
4 wall
5 roller
6 opening
7 ejection position, ejection opening
8 mounting position, buffer tank
9 double-headed arrow
10 substance
11 drive
12 cap
13 supply channels
14 block
15 plunger, compressed air
16, 17, 18 openings

The invention claimed is:

1. A device for sorting incomplete and improperly aligned sets of a plurality of caps which are to be mounted onto drinking straws, said device comprising:

a rotary drum having openings wherein the number of openings is equal to the number of caps in a set of caps, wherein said device is configured to insert one cap of a set of said caps into each of said openings, wherein said device is configured to examine the caps in said openings for completeness of the set of caps and for proper alignment of each of the caps in said set of caps, and wherein said device is configured to rotate said rotary drum to an ejection position and eject the caps if the set of caps is incomplete or any of the caps is improperly aligned, or to rotate said rotary drum to a mounting position for mounting the caps on a set of straws if the set of caps is complete and properly aligned.

2. A device for sorting incomplete and improperly aligned sets of caps which are to be mounted on drinking straws, said device comprising:

a rotary drum having openings wherein the number of openings is equal to the number of caps in a set of caps;

wherein said device is configured so that said caps may be inserted into said openings, where the caps can be examined for completeness of the set of caps and for alignment;

wherein the device is configured so that said rotary drum may be rotated to an ejection position if the set of caps is incomplete or improperly aligned or to a mounting position if the set of caps is complete and properly aligned, and wherein said device is provided with sensors to examine the set of caps for completeness and alignment.

* * * * *